US006131393A

United States Patent [19]

Greene

[11] Patent Number: 6,131,393

[45] Date of Patent: Oct. 17, 2000

[54] COOLING OF STORED WATER

[75] Inventor: Ralph G. Greene, Dalton, Ga.

[73] Assignee: Mutual of Omaha Insurance Company, Omaha, Nebr.

[21] Appl. No.: 09/354,410

[22] Filed: Jul. 15, 1999

Related U.S. Application Data

[63] Continuation-in-part of application No. 09/085,672, May 27, 1998, Pat. No. 5,946,918.

[51] Int. Cl.[7] ..... F25B 21/02

[52] U.S. Cl. ..... 62/3.64; 62/59

[58] Field of Search ..... 62/3.64, 59, 139, 62/393

[56] References Cited

U.S. PATENT DOCUMENTS 4,096,709 6/1978 Barthel ..... 62/59

5,367,879 11/1994 Doke et al. ..... 62/3.64

*Primary Examiner*—William E. Tapolcai

*Attorney, Agent, or Firm*—Merchant & Gould P.C.

[57] ABSTRACT

A chilling chamber (10) connected to a water reservoir (12) or to a pipe (29) within which water flows has a thermally conductive probe (16) which is connected to the cold side of a thermoelectric device (18), the hot side being connected to a heat sink (20). A tube (30) is coiled about the probe and has one end (28) connected with the water in the storage reservoir or pipe and another end (32) connected to a faucet (34). Water as a heat transfer medium (36) is stored within the chilling chamber (10) about the probe (16) and the coil of tubing (30). The probe cools the heat transfer medium which cools the water within the coil of tubing. A check valve (42) releases air in the chamber compressed as an ice ball forms about the probe. Cold water thus flows out the faucet when the faucet is opened for a short time and the water within the coil gradually raises in temperature to again be cooled by the heat transfer medium.

3 Claims, 2 Drawing Sheets

COOLING OF STORED WATER

REFERENCE TO RELATED APPLICATIONS

This application is a continuation-in-part of co-pending U.S. application Ser. No. 09/085,672 filed May 27, 1998, now U.S. Pat. No. 5,946,918.

BACKGROUND OF THE INVENTION

This invention relates to the cooling of water stored in a reservoir as the water is dispensed and more particularly to a cooling chamber for use with a room temperature water storage reservoir from which cooled water is to be dispensed and cooled.

A conventional chiller or cooler used for dispensing liquids such as a cooler/dispenser used for bottled water utilizes refrigeration equipment including a compressor unless the liquid is within a reservoir surrounded by ice or a refrigerant or other heat transfer medium. Examples, of the latter are illustrated in Pique U.S. Pat. No. 2,506,840; Olson U.S. Pat. No. 2,821,844; Geisler U.S. Pat. No. 3,270,520 and Bonimi U.S. Pat. No. 4,238,053; while examples of the former are illustrated in Natter U.S. Pat. No. 3,462,970 and Schroeder U.S. Pat. No. 3,892,335; while Radino U.S. Pat. No. 5,079,927 illustrates a hybrid combination of these. In Moren U.S. Pat. No. 5,544,489 there is disclosed a thermoelectric device having a probe that extends into water within a receptacle to cool the liquid, the thermoelectric device being one which responds to a direct current input to provide one side relatively cooled and one side relatively heated.

One problem that has been recognized with combination chiller-dispensers having a water storage reservoir is that the stored water may easily be contaminated with air-borne bacterial. It has been found that a substantial percentage of such units have bacteria levels above that permitted by governmental regulation. In such storage reservoirs and also in the bottled water used with chilling dispensers air must enter and displace the water to permit the water to exit. Thus, even with apparatus that purifies water, such as that disclosed in Greene et al U.S. Pat. No. 5,662,779, when the water is dispensed through a cooling dispenser, the water may become contaminated when the water is dispensed. As the air enters so does bacteria, mold and viruses carried by the air. These organisms may grow and multiply in the stored water resulting in potential sources of disease. If the water bottle or storage tank into which the air may enter could be eliminated, the growth of bacteria from air-borne sources may be greatly reduced.

This problem was recognized in my aforesaid U.S. patent application Ser. No. 09/085,672 where it was proposed to have chilling and dispensing apparatus including a thermally conductive probe within a cooling chamber in heat conducting contact with the cold surface of a thermoelectric device which produces a cold first surface and a hot second surface, the probe being immersed in a liquid heat transfer medium, preferably water, in which a coil of tubing is disposed about the probe. The coil has an inlet end and an outlet end and thus water fed to the coil may be cooled and dispensed.

As described in my aforesaid patent application, the heat transfer medium around the probe becomes supercooled and, if it is water, forms an ice ball. If the cooling chamber is small so that there is a small amount of cooling water, the ice ball may form quickly. As the ice ball forms, it compresses the air within the cooling chamber and raises the pressure unless a lid on the dispenser housing is opened. However, in that case bacteria laden air may enter, and after a time, the cooling water within the tank begins to have an unpleasant moldy odor.

SUMMARY OF THE INVENTION

Consequently, it is a primary object of the present invention to provide a chiller from which water may be dispensed without the water being stored in the chiller so as to minimize the potential for air-borne bacteria entering the water or entering the chiller.

It is another object of the present invention to provide a chilling chamber having an inlet water tube fed from a source of water at room temperature, the inlet water tube communicating with tubing coiled about a thermoelectric cooling probe disposed within the chilling chamber, the tubing further communicating with a faucet to dispense water from the coil selectively, and the chilling chamber being closed against entry of air-borne bacteria.

It is a further object of the present invention to provide a chilling chamber having an inlet water tube fed from a source of water at room temperature, the inlet water tube communicating with tubing coiled about a thermoelectrically cooled probe disposed within the cooling chamber, water heat transfer medium being disposed within the cooling chamber surrounding the probe and coil so that the probe chills the water heat transfer medium which cools the water within the coil, the chilling chamber being closed against entry of air and thus bacteria carried therein.

Accordingly, the present invention provides a chilling chamber in which a thermally conductive probe is disposed, the probe being connected to the cold side of a thermoelectric device having its hot side connected to a heat sink outside the chamber, The chilling chamber has an inlet communicating with a water supply and with tubing coiled about the probe and communicating with an outlet valve, the chilling chamber having water as a heat transfer medium therein which is chilled by the probe and absorbs heat from the water within the coil to cool the water within the coil. The water that is dispensed through the outlet valve flows continuously so that air does not enter the tubing and displace the water, and the water that acts as the cooling medium is protected against air entering the chamber by the provision of a check valve between the chamber and the room in which the chamber is located. Thus, air-borne bacteria and other contaminants do not enter the water supply or storage reservoir. Additionally, since the cooling is effected from the probe to the heat transfer medium within the chilling chamber and not directly from the probe to the water being dispensed, as in aforesaid U.S. Pat. No. 5,544,489, water that has been purified by distillation, as in the aforesaid Greene et al U.S. Pat. No. 5,662,779, or by reverse osmosis, and thus is low in dissolved solids, is not affected by the inefficiencies associated with direct transfer of heat from such pure water. Generally, water low in impurities does not transfer heat as readily as water high in such impurities.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
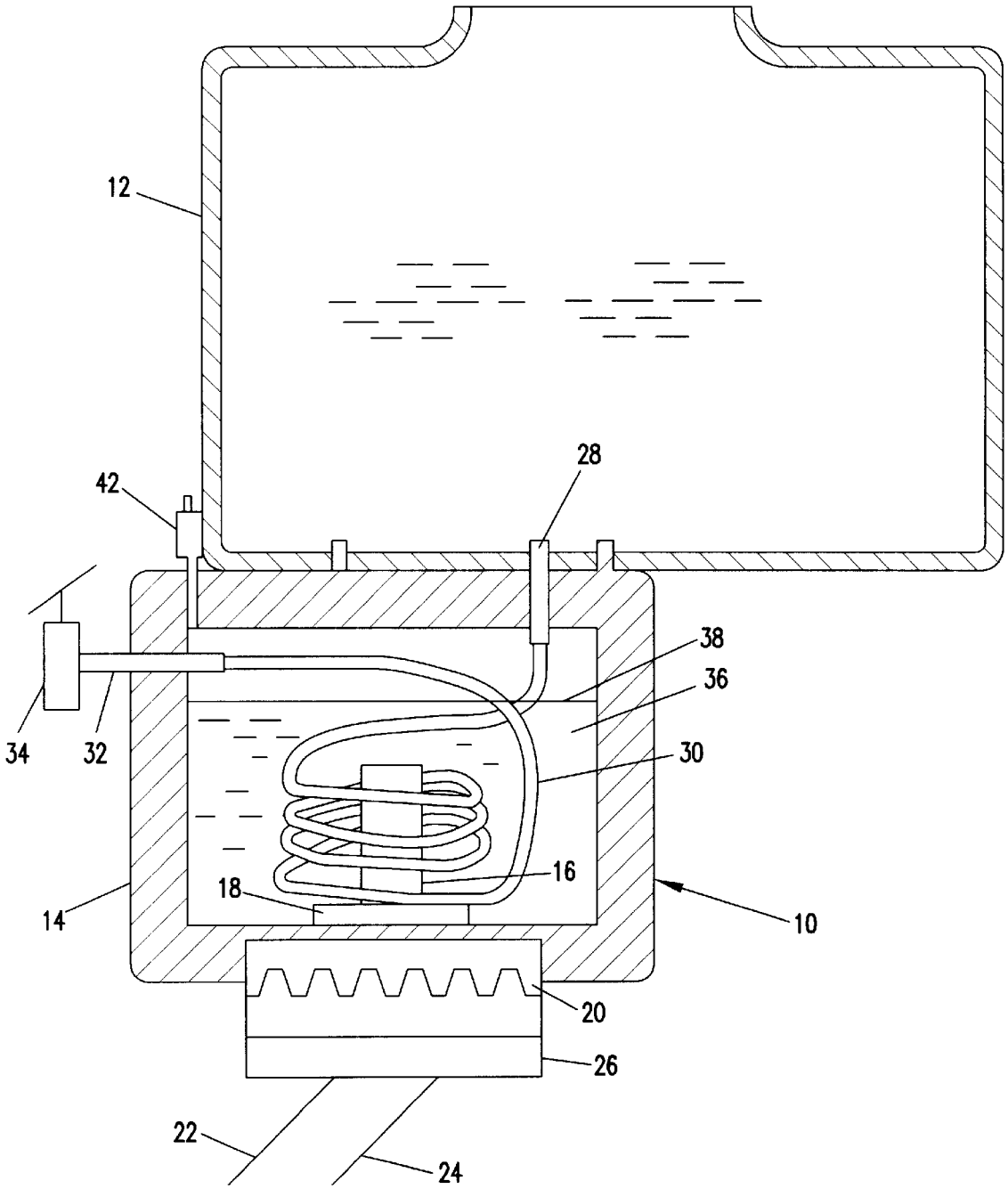
FIG. 1 is a diagrammatic elevational view partly in section illustrating a chilling chamber constructed in accordance with the principles of the present invention in combination with a water reservoir.
Figure 2:
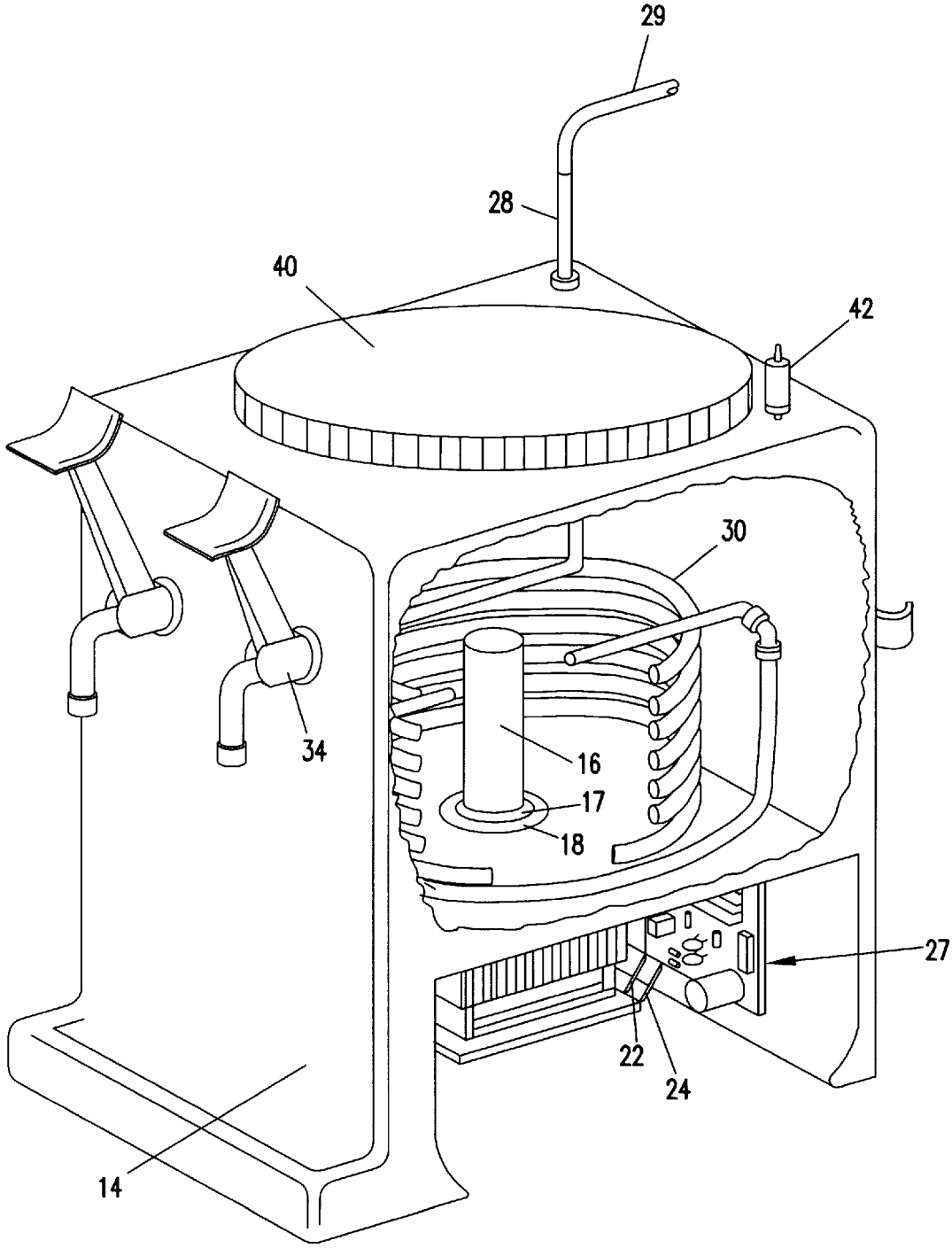
FIG. 2 is a perspective view with parts thereof broken away illustrating a portion of a stand alone water chiller incorporating a chilling chamber in accordance with the present invention shown connected to conventional water supply piping.

Referring to the drawings, FIG. 1 illustrates a chilling or cooling chamber 10 constructed in accordance with the present invention operatively connected to a water storage tank or reservoir 12, which may be the storage reservoir of a water purifier such as that in Greene et al U.S. Pat. No. 5,662,779, containing water at room temperature, or alternatively may be connected to water supply piping as illustrated in FIG. 2. The chilling chamber 10 is a reservoir or housing having a thermally insulated wall structure 14. Extending through a hole in the wall is a thermally conductive probe 16 which in accordance with the disclosure in the aforesaid U.S. Pat. No. 5,544,489 is connected through a conductive base portion 17 of the probe as illustrated in FIG. 2, to a thermoelectric device 18 which in turn is connected to a heat sink 20. The thermoelectric device 18 is a commercially available device producing a reduced temperature on one side and a raised temperature on the other side when a d.c. voltage is applied by conductors 22, 24 across the device. In regard to the present invention, the cold side faces the interior of the chilling chamber 10 and the hot side faces the heat sink 20. The probe 16, is cooled by conduction of the cold side of the thermoelectric device 18 through the base of the probe. A fan 26 may act to blow air to withdraw heat from the heat sink 20 as in the aforesaid U.S. Pat. No. 5,554,489, the disclosure therein being incorporated herein by reference. A power supply 27 connected to a source of electricity may be used for connecting to the conductors 22, 24 and the fan 26.

Connected in flow communication with the storage tank 12 is an inlet tube or first end 28 of a coil of tubing 30, the end 28 of the coil communicating with the tank 12 as illustrated in FIG. 1 or with a water supply pipe 29 as illustrated in FIG. 2. The tubing 30 is coiled about the probe 16 substantially in helical fashion and has the outlet or second end 32 connected through a wall of the chilling chamber in flow communication with a valve or faucet 34 so that when the faucet is open chilled water may flow from the tank 12 through the coil 30 and out the faucet. The faucet may be any device which permits the water to flow selectively through the tubing, and may be designated a spigot, stopcock or petcock. Additionally located within the chilling chamber 10 is a liquid heat transfer medium 36 which preferably is water, the level 38 of the water 36 being above the top of the probe 16 and preferably also the coil 30. In a chiller, as illustrated in FIG. 2, the capacity of the chilling chamber 10 is one gallon while there is approximately ¾ gallon of water within the chamber.

With such a construction, the water heat transfer medium or cooling water 36 becomes supercooled around the probe 16. An iceball therefore forms around the probe and gradually enlarges until it reaches equilibrium which is determined by the cooling liquid volume, its composition and the amount of insulation of the chamber. If the chilling chamber is small, sealed and well insulated, the iceball forms quicker. Having the liquid chilled as it flows through a thermally conductive tube, as opposed to the direct cooling approach in the aforesaid U.S. Pat. No. 5,544,489, allows the size of the chilling chamber to be relatively small. To form ice, the thermoelectric device must first cool the liquid in the cooling chamber down to near freezing temperature, then ice will slowly form layer by layer around the outside of the chilling probe. The forming of ice will occur much faster if the volume of liquid that must be chilled is small. Freezing of the water within the coil is prevented by sizing the coil diameter, the insulation and the water cooling medium to the inherent temperature regulation of the stored cooling energy. It may be noted that the liquid temperature surrounding the ice that is formed is approximately 39 degrees F. which is much colder than required. Directing the liquid to be cooled through a thermally conductive tube slows the transfer of cooling effects and raises the temperature of the dispensed liquid gradually as the liquid is dispensed. The first few cups or glasses of water out of the cooling tube will thus be substantially as cold as the liquid in the chilling reservoir. After a couple of cups or glasses are dispensed, the temperature of the dispensed liquid will rise gradually. If there is a period of time that passes between dispensed cups or glasses of water, the temperature will again lower to approximately that of the liquid temperature of the chilled water in the chilling reservoir.

As the ice ball forms and the ice displaces the water and expands, the pressure of the air within the cooling chamber increases as it is compressed. In order to release this pressure, the lid 40 had to be opened, and, as aforesaid, this permitted bacteria laden air to enter, and if the lid remained off, some of the cooling water within the cooling chamber would evaporate. Ideally, it is desirable that the lid 40 be closed in sealed fashion after the cooling chamber is filled to the desired level. Accordingly, the present invention provides a check valve 42 in the upper portion of the cooling chamber communicating with ambient conditions so that as the ice ball within the chamber expands and the air is compressed, air is forced out the valve until the pressure within the chamber is equalized with the pressure outside the cooling chamber. As with any check valve, the flow is in one direction and air cannot reenter the cooling chamber. Thus, the lid may be sealed or at least not reopened after the chamber has been filled so that cleanliness of the tank or chamber is insured. Moreover, if the ice ball shrinks, as when a substantial amount of water is being dispensed, thereby transferring heat from the water in the coil 30 to the water 38 in the cooling chamber, the volume of water in the tank contracts such that there is a greater volume in the tank for the remaining air. Thus, the pressure of the air drops to create a slight sub-atmospheric pressure since the check valve 42 does not permit reentry of air into the cooling chamber.

The length of the tubing 30, its diameter and material are selected to control the temperature of the room temperature water in the reservoir 12 as it is dispensed from the chilling chamber 10. As aforesaid, the output temperature of the dispensed water for the first cup or two is substantially equal to or a few degrees above the temperature of the chilled water reservoir. As more water is dispensed, the temperature of the dispensed water gradually increases, but if a minute or more is allowed between dispensing of a cup or glass of water, the temperature will decrease accordingly.

As aforesaid, the cooling system may be used in conjunction with a water purifying system as in Greene et al U.S. Pat. No. 5,662,779, or may be used with in-line cooling using the chilling system of the present invention, i.e., connected to water supply piping.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for chilling and dispensing water received from a water supply, comprising a chilling chamber, a thermally conductive probe disposed within said chamber, a thermoelectric device operable for producing a first surface having a relatively cold temperature and a second surface having a relatively hot temperature, said first surface being in heat conducting contact with said probe, a heat sink disposed outside said chamber, said second surface being in heat conducting contact with said heat sink whereby said probe may be cooled and heat energy therein transferred to said heat sink and dispersed to ambient environment outside said chamber, a coil of tubing disposed about said probe, said coil of tubing having a first end and a second end, an inlet member operatively connecting said first end in flow communication with said water supply, a faucet operatively connected in flow communication to said second end of said coil for dispensing water selectively from said tubing, water providing a liquid heat transfer medium within said chamber surrounding said probe and at least a substantial portion of said coil of tubing for transferring heat from the water within said coil to said probe, and a check valve communicating the interior of said chamber with ambient environment outside said chamber to permit air within said chamber to be released when the pressure of air within said chamber is above ambient.

2. Apparatus for chilling and dispensing water as recited in claim 1, wherein said water supply comprises a water reservoir.

3. Apparatus for chilling and dispensing water as recited in claim 1, wherein said water supply comprises water flowing in a pipe.

* * * * *